US005478711A

United States Patent [19]

Chen et al.

[11] Patent Number: 5,478,711

[45] Date of Patent: Dec. 26, 1995

[54] PHOTOGRAPHIC ELEMENTS CONTAINING DEVELOPMENT ACCELERATORS AND RELEASE COMPOUNDS THAT RELEASE DEVELOPMENT INHIBITORS

[75] Inventors: Keath T. Chen, Rochester; John V. Nelson, Fairport; David A. Dickinson, Brockport; Thomas R. Welter, Webster, all of N.Y.

[73] Assignee: Eastman Kodak Company, Rochester, N.Y.

[21] Appl. No.: 250,748

[22] Filed: May 27, 1994

[51] Int. Cl.[6] ..... G03C 7/305

[52] U.S. Cl. ..... 430/544; 430/550; 430/602; 430/603; 430/605; 430/611; 430/957

[58] Field of Search ..... 430/544, 550, 430/957, 602, 603, 611, 605

[56] References Cited

U.S. PATENT DOCUMENTS

| | | | |
|---|---|---|---|
| 2,996,382 | 8/1961 | Luckey et al. | 96/68 |
| 3,178,282 | 4/1965 | Luckey et al. | 96/68 |
| 3,397,987 | 8/1987 | Luckey et al. | 96/109 |
| 3,674,478 | 7/1972 | Grasshoff et al. | 430/957 |
| 4,082,553 | 4/1978 | Groet | 96/74 |
| 4,292,400 | 9/1981 | Pollet et al. | 430/383 |
| 4,543,317 | 9/1985 | Mehta et al. | 430/957 |
| 4,626,498 | 12/1986 | Shuto et al. | 430/379 |
| 4,656,122 | 4/1987 | Sowinski et al. | 430/505 |
| 4,729,936 | 3/1988 | Kitaguchi et al. | 430/957 |
| 4,886,738 | 12/1989 | Deguchi et al. | 430/510 |
| 4,923,787 | 5/1990 | Harder | 430/489 |
| 5,041,367 | 8/1991 | Sniadoch | 430/603 |
| 5,084,376 | 1/1992 | Suda et al. | 430/957 |
| 5,116,717 | 5/1992 | Matsushita et al. | 430/957 |
| 5,283,162 | 2/1994 | Kapp et al. | 430/957 |

OTHER PUBLICATIONS

USSN 08/148,805 filed Nov. 5, 1993.

*Primary Examiner*—Richard L. Schilling
*Attorney, Agent, or Firm*—Peter C. Cody

[57] ABSTRACT

A photographic element comprising a support having located thereon at least one silver halide emulsion layer, the emulsion layer containing a development accelerator and a release compound that provides a non-imagewise distribution of a development inhibitor moiety. The release compound is characterized in that it comprises a blocking group from which the development inhibitor moiety is released.

15 Claims, No Drawings

PHOTOGRAPHIC ELEMENTS CONTAINING DEVELOPMENT ACCELERATORS AND RELEASE COMPOUNDS THAT RELEASE DEVELOPMENT INHIBITORS

FIELD OF THE INVENTION

The invention relates to silver halide elements. In particular, it relates to photographic elements containing development accelerators and release compounds that release development inhibitors.

BACKGROUND OF THE INVENTION

In modern photographic materials, it is known to incorporate development inhibitor compounds or compounds capable of releasing development inhibitors or precursors thereof, in order to arrest development and optimize certain photographic characteristics. Characteristics which may be impacted by the presence of development inhibitor compounds include sharpness, granularity, contrast and color reproduction.

In certain instances, it is often desired to coat a development inhibitor in one layer of the photographic element and have it exert its effects on adjacent or other layers. It is also often desired that development inhibitors not exert their effects during the initial stages of development but rather after extended development times. In such instances, it has become commonplace to alter the structure of development inhibitors so that they are inactivated by a blocking or timing group. The inactivated development inhibitors are then activated after either a period of exposure to compounds normally present in processing solutions, or after exposure to a specific compound capable of splitting-off the blocking or timing group.

Examples of photographic elements containing development inhibitor moieties can be found in U.S. Pat. Nos. 5,041,367, 3,397,987 and 4,886,738.

In U.S. Pat. No. 5,041,367, photographic recording materials are disclosed having improved sharpness and enhanced interlayer interimage effects. The recording materials comprise an unblocked 5- or 6-membered heterocyclic ring containing development inhibitor compound and a polymeric development accelerator compound.

In U.S. Pat. No. 3,397,987, photographic emulsions are described having unfogged surface latent image grains and fogged internal silver halide grains on which is adsorbed a heterocyclic nitrogen containing development fog inhibiting compound. The development fog inhibiting compound is free and is thus unblocked.

In U.S. Pat. No. 4,886,738, color photographic materials are disclosed having one of two types of development inhibitor compounds positioned in a colloidal silver containing layer. The development inhibitor compounds are adsorbed to the colloidal silver and gradually separate therefrom during development. After separation from the colloidal silver, the development inhibitor compounds diffuse into a photosensitive emulsion layer and impact such photographic properties as $D_{max}$ (i.e. maximum density on the emulsion's characteristic curve) and speed.

In U.S. Pat. No. 4,626,498, color reversal photographic light sensitive materials having a light sensitive silver halide emulsion layer and a layer adjacent thereto are disclosed. The layer adjacent to the emulsion layer contains an organic compound and silver halide grains containing internal fog centers. The organic compound may be a heterocyclic mercapto compound such as phenyl mercaptotetrazole. Such heterocyclic mercapto compounds are generally known in the art as unblocked development inhibitors.

In U.S. Pat. No. 5,354,650, blocked development inhibitor moieties are disclosed which provide, in an imagewise manner after reaction with a second compound that is photographically inert in the layer in which it is coated, or in the form in which it is released, a development inhibitor moiety.

In U.S. Ser. No. 08/250,148, filed May 27, 1994, release compounds are disclosed which provide a non-imagewise distribution of a photographically active moiety, of which development inhibitors are included. The release compounds comprise a blocking group from which the development inhibitor is released, a ballasting group other than a coupler moiety, which is attached to the blocking group, and an aqueous solubilizing group which is also attached to the blocking group.

One of the disadvantages associated with utilizing blocked development inhibitor moieties is that they often do not allow one to optimize photographic characteristics over a wide range of different photographic elements and processing conditions. For instance, in U.S. Pat. No. 5,354,650, release of the development inhibitor is only in an imagewise manner. Thus, non-imagewise control is lost.

By contrast, the release compounds of U.S. Ser. No. 08/250,148, filed May 27, 1994, can release development inhibitors in a non-imagewise manner, and as a result of exposure to nucleophiles normally present in the processing solutions. These release compounds provide excellent results when incorporated into reversal elements that are push processed. Push processing is a speed adjusting process utilized to compensate for insufficient exposure of one or more of the color records of a color reversal light sensitive material. Typically, it is accomplished by "pushing" the first of the development stages (i.e. black and white) of reversal processing; that is, it is accomplished by prolonging the period of first development longer than that employed in normal processing.

The release compounds of U.S. Ser. No. 08/250,148, filed May 27, 1994 are useful in elements that are push processed because they tend to release their development inhibitors after extended development times. Thus, they impact the characteristics of the photographic element primarily after the initial development phase. This allows one to affect color balance by slowing the development of one silver halide emulsion layer during the push phase while simultaneously allowing the other silver halide emulsion layers to continue developing without restraint.

Although some of the blocked or timed inhibitors known in the art are capable of impacting photographic properties primarily during the push phase of reversal processing, at certain levels or in certain photographic elements, they may also exert a small effect during the pre-push phase. This small effect, though often minimal, may be undesired as it can limit the ability of the release compounds to adequately impact speed and color correction. For this reason, it is desired to provide a photographic element containing blocked development inhibitors wherein the impact of the development inhibitors, once released, is minimized during the pre-push phase of reversal processing and maximized during the push phase.

It is also desired to provide photographic elements that exhibit adequate sensitivity changes when subjected to development inhibitors that have been released from blocking groups.

SUMMARY OF THE INVENTION

It is thus an object of the present invention to provide a photographic element exhibiting adequate sensitivity changes when subjected to development inhibitors that have been released from blocking groups.

It is a further object of the invention to provide a photographic element containing blocked development inhibitors wherein the impact of the development inhibitors, once released, is minimized during the pre-push phase of reversal processing and maximized during the push phase.

These and other objects of the invention, which will be apparent from the description that follows, are accomplished by a photographic element comprising a support having located thereon at least one silver halide emulsion layer, the emulsion layer containing a development accelerator and release compound that provides a non-imagewise distribution of a development inhibitor moiety, the release compound comprising a blocking group from which the development inhibitor moiety is released.

The advantages obtainable by the present invention are most clearly demonstrated in color reversal or black and white photographic elements that comprise as the release compound: a development inhibitor moiety and a blocking group from which the development inhibitor moiety is released, a ballasting group other than a coupler moiety, and an aqueous solubilizing group, both the ballasting group and the aqueous solubilizing group being attached to the blocking group.

The present invention employs a combination which enables those skilled in the photographic arts to specifically control the photographic properties of multiple types of photographic elements under various processing conditions. In reversal elements, the combination provides that the impact of a development inhibitor released from a blocking group is minimized during the pre-push phase of reversal processing and maximized during the push phase.

The present invention also provides photographic elements that exhibit adequate sensitivity when subjected to development inhibitors that have been released from blocking groups.

DETAILED DESCRIPTION OF THE INVENTION

The present invention relates to a photographic element containing a development accelerator and a release compound that provides a non-imagewise distribution of a development inhibitor moiety. The release compound comprises a blocking group from which the development inhibitor moiety is released. Preferably, it also comprises a ballasting group other than a coupler moiety, and an aqueous solubilizing group, both the ballasting group and the aqueous solubilizing group being attached to the blocking group.

In a preferred embodiment of the invention, the photographic element contains a release compound comprising, as the blocking group, an aromatic ring system which is unsubstituted or substituted with one or more electron withdrawing groups and, optionally, a timing group or series of timing groups, from which the development inhibitor moiety is released.

By timing group, it is meant any of the timing groups known in the art, preferably those that function by electron transfer down a conjugated chain or by cyclization reaction (nucleophilic displacement). Other groups which decompose to form small molecules such as carbon dioxide or formaldehyde are also contemplated. Suitable timing groups for practice with the present invention include those disclosed in U.S. Pat. Nos. 4,248,962; 4,409,323; 4,684,604; 5,034,311 and 5,055,385; and European Patent Application 0 167 168; all of which are incorporated herein by reference. Multiple timing groups are specifically contemplated and these may be the same or they may be different.

As indicated, the preferred release compounds comprise an aromatic ring system from which, when no timing groups are present, the development inhibitor moiety is released. When at least one timing group is present, the aromatic ring system releases both the timing group and the development inhibitor moiety. The timing group then releases the development inhibitor moiety in accordance with its release profile.

By aromatic ring system, it is meant a group having at least one aromatic ring, preferably a 5, 6, or 7 membered ring, from which a development inhibitor moiety or timing group is released. The aromatic ring system may be monocyclic or polycyclic. It may be comprised of entirely carbon atoms, or it may contain heteroatoms so as to form a heteroaromatic ring system. Specific examples of the aromatic ring system include benzene, pyridine, pyrrole, furan, thiophene, imidazole, thiazole, oxazole, pyrazole, isothiazole, isoxazole, triazole, tetrazole, pyrimidine, pyrazine, and similar rings. Furthermore, such rings may be substituted. Substituents include halogen, alkyl, alkenyl, alkynyl, aryl, heteroaryl, carboxy, carbonamido, sulfonamido, nitro, cyanofluoroalkyl, fluorosulfonyl, amino, sulfamyl, carbamyl, formyl, arylcarbonyl, alkylcarbonyl, carboxyaryl, carboxyalkyl, alkyl-carbonamido, arylcarbonamido, fluoroarylsulfonyl, fluoroalkylsulfonyl, aryloxy, alkyloxy, arylthio, alkylthio, phosphenyl, and the like. Other suitable substitutents include oxo, imine, oximino, alkylidene, arylidine, thio, and azimino, and these subsitutents, if present, are preferably on a ring other than the ring from which the development inhibitor moiety or timing group is released.

It is preferred that the aromatic ring system employed in the present invention comprise at least one 5, 6, or 7 membered carbocyclic, non-heteroaromatic, ring from which the timed or untimed development inhibitor moiety is released. The carbocyclic ring is preferably substituted with at least two electron withdrawing groups. Preferred examples of such a carbocyclic ring or ring systems including at least one carbocyclic ring include benzene, naphthalene, indene, fluorene, anthracene, phenanthrene indole, isoindole, benzimidazole, benzoxazole, benzothiazole, benzofuran, benzothiophene, quinoline, isoquinoline, quinoxaline, quinazoline, phthalazine, cinnoline, carbazole, dibenzofuran, dibenzothiophene and the like. These may be substituted or unsubstituted as described above.

The preferred release compounds of the present invention also comprise a ballasting group which ideally, is attached to the blocking group. Thus, the ballasting group may be found on either (or both) the timing group or the aromatic ring system. Preferably, it is found on the aromatic ring sytem. In limited instances, when the aromatic ring system is a 5, 6, or 7 membered carbocyclic ring, the ballasting group may also be found on the development inhibitor moiety.

Ballasting groups known in the art are suitable for the present invention. Preferably, they are groups which prevent substantial migration of the release compounds within the photographic element. Migration should be limited during both shelf keeping and processing. Preferably, the ballasting groups are large organic molecules, typically containing at least 8, preferably containing at least 12, and more preferably at least 15, contiguous atoms and including substituted or unsubstituted alkyl, aryl, or aralkyl groups.

Known ballasting groups suitable for the present invention include 4-tridecyloxyphenyl, 4-(2,4-di-t-pentyl-phenoxy)butyl, 3-pentadecylphenyl, n-octadecyl, 5-tetradecylcarbonamido-2-chlorophenyl, 5-(N-methyl-N-octadecyl sulfamoyl)-2-chlorophenyl, 2-tetradecyl-oxyphenyl and 4-t-octylphenoxyphenyl. These groups, as well as other ballasting groups capable of being employed in the present invention, may further comprise an aqueous solubilizing group. In such instances, when the ballasting group contains an aqueous solubilizing portion (group) and is attached to the aromatic ring system, the aqueous solubilizing portion can not be directly attached to the aromatic ring system. Instead, it must be indirectly attached to the aromatic ring system through at least one carbon atom, preferably at least three carbon atoms, and more preferably at least five carbon atoms. It is also preferred that the ballasting group and aqueous solubilizing portion not be linearly attached to each other but rather branch from an intervening carbon atom.

in instances where the ballasting group contains the aqueous solubilizing group and is attached to a timing group, it is contemplated that the aqueous solubilizing portion (group) be attached directly to the timing group. It is preferred, however, that the orientation of aqueous solubilizing portion to the ballasting group be as described above for when the ballasting group containing the aqueous solubilizing group is attached to the aromatic ring system.

In a preferred embodiment, the release compounds comprise a water solubilizing group that is attached, either directly or indirectly, to the timing group, or is attached indirectly through at least one carbon atom to the aromatic ring system. By aqueous solubilizing group, it is meant any group capable of facilitating the removal of the aromatic ring system at a useful rate in a nucleophile containing processing bath. The group should have an intrinsic hydrophilicity, or should be such as to be capable of substantial ionization under processing conditions. Examples include carboxylic acids; sulfonamides; thiols; cyanamides; ureas; sulfonylureas; imides; sulfonic acids; polyethers having greater than 2 repreating units; amines and polyamines; cationic centers such as ammonium, sulfonium or phosphonium groups; amides such as carbonamides or phosphonamides; alcohols or polyalcohols; and salts thereof.

The most preferred groups are selected from carboxy, carboxyalkyl, sulfo, sulfoalkyl, sulfonamides, phosphato, phosphatoalkyl, phosphono, phosphonoalkyl, carbonamido, sulfonamido, hydroxy, and salts thereof. Optimally, the groups are carboxy or sulfo, and salts thereof.

In the present invention, the aqueous solubilizing group enables the aromatic ring system to be removed from the blocking group during processing as a result of reaction with a nucleophile contained in the processing bath, thus releasing the timed or untimed development inhibitor moiety. The nucleophile contained in the processing bath can include any nucleophile present in processing baths; preferably sulfite ions, oximes, hydroxylamines, thiocyanates, or thiolates; more preferably ions other than oxygen or nitrogen nucleophiles; and optimally sulfite ions. Sulfite ions are typically present in developer baths, fixing baths, conditioner baths, and bleach accelerator baths. They can come from salts of sulfite, such as sodium sulfite or potassium sulfite; salts of bisulfite such as sodium bisulfite, potassium bisulfite, or sodium formaldehyde bisulfite; or salts of metabisulfite, such as sodium metabisulfite or potassium metabisulfite. The concentration of sulfite can be in the range of 0.0001 to 2.0 molar, preferably in the range 0.01 to 1.0 molar.

The development inhibitor moieties employed in the release compounds of the present invention can be any of those known in the art. These include those described in U.S. Pat. Nos. 5,151,343, 4,861,701 4,962,018, 4,782,018 and *Research Disclosure* December 1989, Item 308119, Section XXI E, published by Kenneth Mason Publications, Ltd., Dudley Annex, 12a Northe Street, Emsworth Hampshire PO10 7DQ, England, the disclosures of which are incorporated herein by reference.

Preferred development inhibitor moieties include substituted or unsubstituted mercaptotetrazoles, mercaptotriazoles, mercaptoimidazoles, mercaptopyrimidines, mercaptobenzimidazoles, mercaptooxadiazoles, mercaptothiadiazoles, mercaptobenzothiazoles, mercaptobenzoxazoles, benzimidazoles indazoles, and substituted or unsubstituted symmetric or unsymmetric benzotriazoles.

The development inhibitor moiety is inert when attached to the timing group or aromatic ring system. Only upon release from these two groups can the development inhibitor moiety exert its intended effect. By inert, it is meant the moiety does not substantially inhibit development. It may, however, exert other incidental photographic effects.

The development inhibitor moiety preferably contains a heteroatom which is blocked by direct attachment to the timing group or aromatic ring system. Upon removal of the timing group, when present, and the aromatic ring system upon reaction of the release compound with a nucleophile contained in the processing bath, the development inhibitor moiety becomes active for its intended purpose.

In the preferred embodiments of the present invention, the release compound has the structure

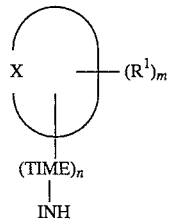

wherein

X represents the atoms to complete an aromatic ring system;

$R^1$ is an electron withdrawing moiety;

m is 0, 1, 2 or 3, preferably 2 or 3;

TIME is a timing group;

n is 0, 1, 2 or 3, preferably 0 or 1;

INH is a development inhibitor moiety; and wherein the release compound further comprises a ballasting group other than a coupler moiety, and an aqueous solubilizing group, the ballasting group attached either directly or indirectly to TIME or X, and the aqueous solubilizing group attached either directly or indirectly to TIME, or attached indirectly to X through at least one carbon atom.

Preferably, X represents the atoms necessary to complete a five or six membered aromatic ring comprised of substituted or unsubstituted carbon atoms, or nitrogen atoms wherein no more than three nitrogen atoms are present in the ring. When the ring is carbocyclic, that is comprised of substituted or unsubstituted carbon atoms, it may be fused to a heterocyclic ring or other carbocyclic rings. In this manner, it is contemplated that X can represent a moiety having the following structure:

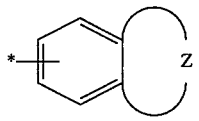

wherein z represents the atoms to form a fused heterocyclic or carbocyclic ring. These atoms may be further substituted and may be fused with additional heterocyclic or carbocyclic rings. * designates the point of attachment of X to $(TIME)_n$-INH.

Electron withdrawing groups are those groups which display a positive Hammett sigma value as described, for example, in Advanced Organic Chemistry by F. A. Carny and R. J. Sundberg, volume A, pages 179–190; Plenum Press, New York 1984. Examples include nitro; nitroso; azide; azo; cyano; aryl or alkyl sulfones sulfoxides and ketones; aryloxy or alkyloxy carboxylate esters; sulfonate esters; phospahte esters; arylamino or alkylamino carboxylic amides; tertiary substituted alkylamino or arylamino sulfonamides; halogen; fluoroalkyl; and other similar groups. In the present invention, the electron withdrawing group is prefereably non-ionizable under alkaline conditions.

Preferably, the ballasting group is attached either directly or indirectly to X, and the aqueous solubilizing group is attached indirectly to X through at least one carbon atom.

In even more preferred embodiments, the release compound is selected from

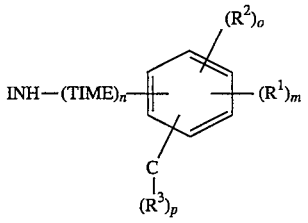

and

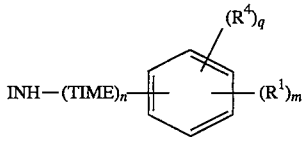

wherein $R^1$, m, n, TIME and INH are as defined before;

$R^2$ is a group containing a ballasting group;

o is 1 or 2, preferably 1;

$R^3$ is a group containing an aqueous solubilizing group;

p is 1 or 2, preferably 1;

$R^4$ is a group containing both a ballasting group and an aqueous solubilizing group, wherein the aqueous solubilizing group is attached to the six-membered carbocyclic ring through at least one, preferably at least three, and optimally at least five, carbon atoms that are not part of the solubilizing group; and q is 1 or 2, preferably 1.

Preferably, $R^4$ comprises a substituted or unsubsituted aromatic group having attached thereto

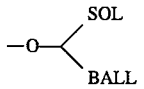

wherein

SOL is an aqueous solubilizing group; and

BALL is a ballasting group.

Optimally, the release compound employed in the present invention has the structure

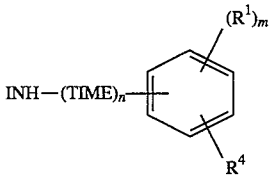

wherein $R^1$, m, n, TIME and INH are as defined before, and $R^4$ is represented by the structure

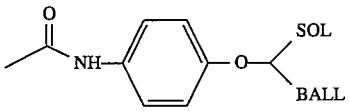

wherein BALL is a ballasting group, preferably one containing at least six carbon atoms, and more preferably a substituted or unsubstituted alkyl chain containing greater than 8 contiguous carbon atoms. SOL is as previously defined and is optimally a carboxy group. $R^1$ is as previously defined and is optimally a nitro group, with m being 2.

Representative examples of the release compounds employed in the present invention are shown in the following tables.

TABLE I-A-1

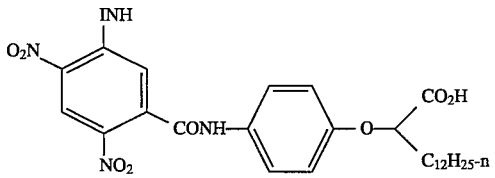

| Cmpd. No. | INH |
|---|---|
| 1 | 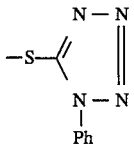 |

TABLE I-A-1-continued
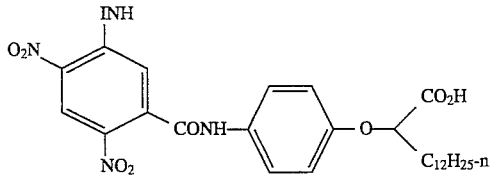
| Cmpd. No. | INH |
|---|---|
| 2 | 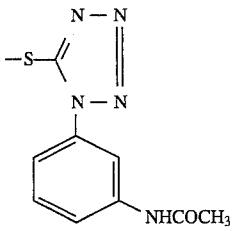 |
| 3 | 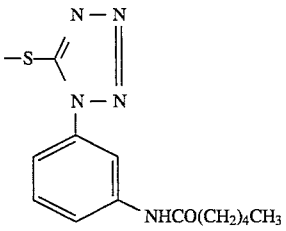 |
| 4 | 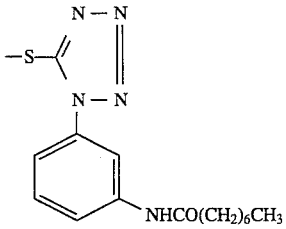 |
| 5 | 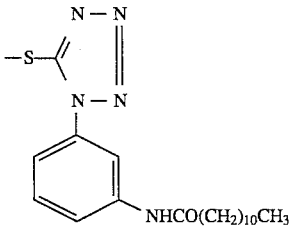 |
| 6 | 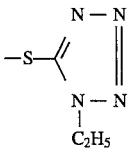 |
| 7 | 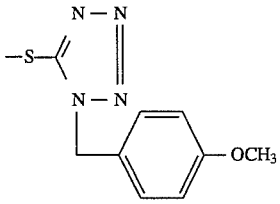 |
| 8 | 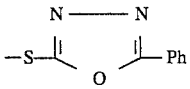 |
TABLE I-A-1-continued
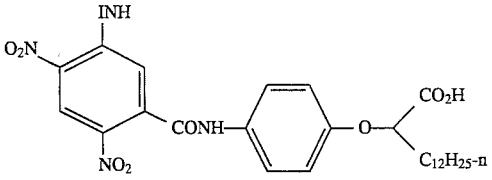
| Cmpd. No. | INH |
|---|---|
| 9 | 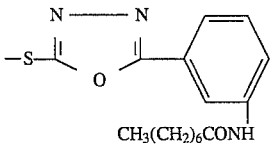 |
| 10 | 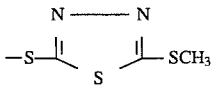 |
| 11 | 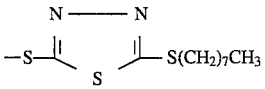 |
| 12 | 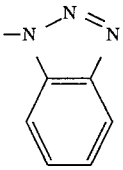 |
| 13 | 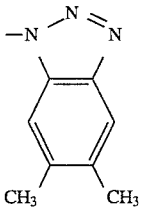 |
| 14 | 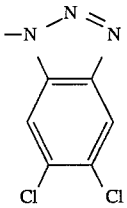 |
| 15 | 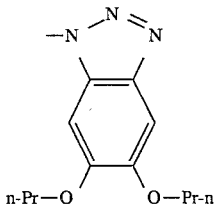 |

TABLE I-A-1-continued
| Cmpd. No. | INH |
|---|---|
| 16 | 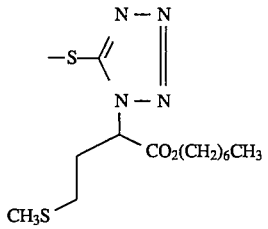 |
TABLE I-A-1-continued
| Cmpd. No. | INH |
|---|---|
| 17 | 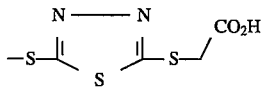 |
TABLE I-A-2
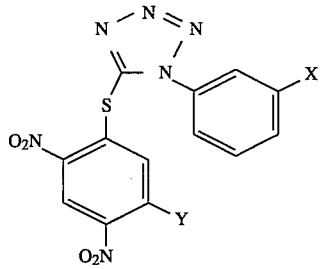
| Cmpd # | X | Y |
|---|---|---|
| 21 | H | 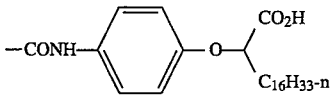 |
| 22 | $-CONHCO(CH_2)_6CH_3$ | 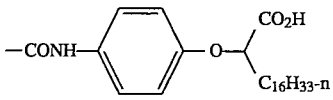 |
| 23 | $-CONHCO(CH_2)_6CH_3$ | 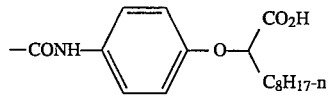 |
| 24 | H | 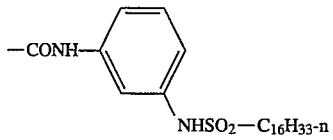 |
| 25 | $-NHCO(CH_2)_6CH_3$ | 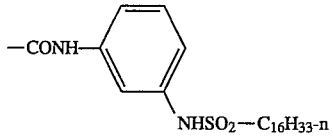 |
| 26 | H | 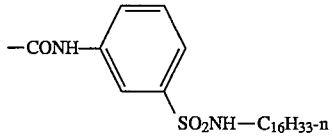 |

TABLE I-A-2-continued
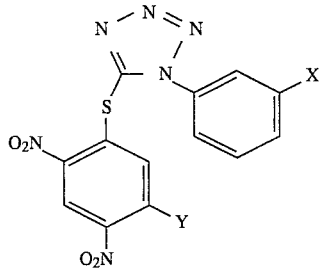
| Cmpd # | X | Y |
|---|---|---|
| 27 | $-NHCO(CH_2)_6CH_3$ | 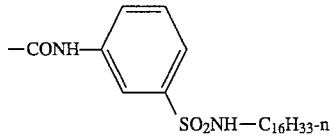 |
| 28 | H | 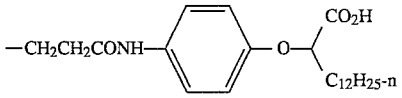 |
| 29 | $-NHCO(CH_2)_6CH_3$ | 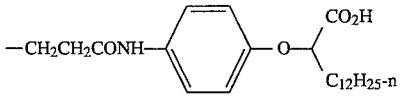 |
| 30 | $-NHCO(CH_2)_6CH_3$ | 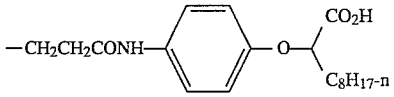 |
TABLE I-A-3
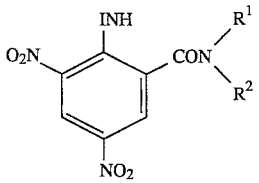
| Cmpd. # | $R^1$ | $R^2$ | INH |
|---|---|---|---|
| 31 | H | 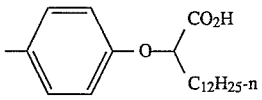 | 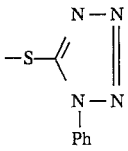 |
| 32 | H | 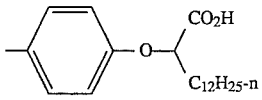 | 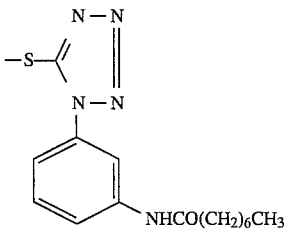 |

TABLE I-A-3-continued
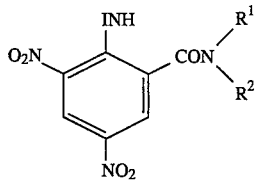
| Cmpd. # | $R^1$ | $R^2$ | INH |
|---|---|---|---|
| 33 | H | 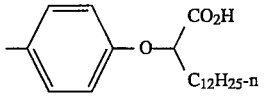 | 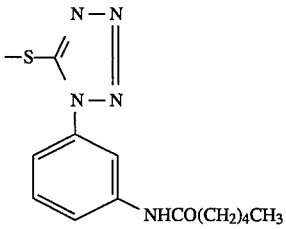 |
| 34 | H | 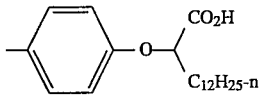 | 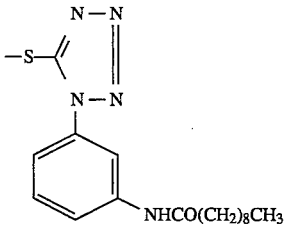 |
| 35 | H | 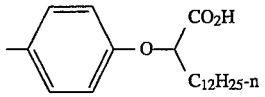 | 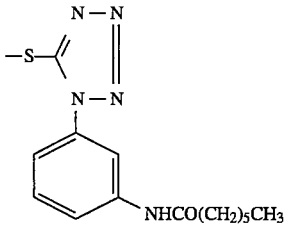 |
| 36 | H | 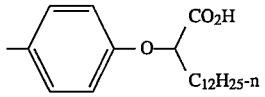 | 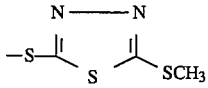 |
| 37 | H | 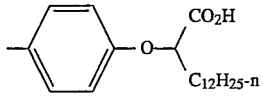 | 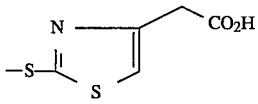 |
| 38 | H | 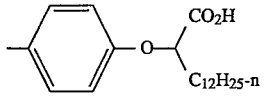 | 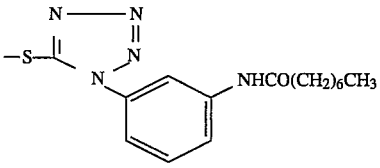 |
| 39 | $CH_3$ | 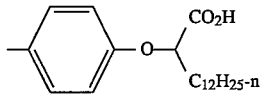 | 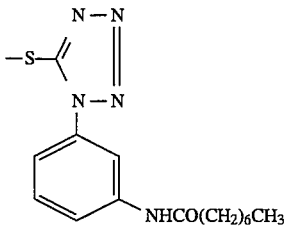 |

TABLE I-A-4
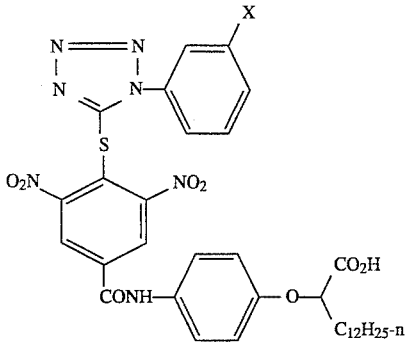
| Cmpd. # | X |
|---|---|
| 40 | H |
| 41 | $-NHCO(CH_2)_6CH_3$ |
TABLE I-A-4-continued
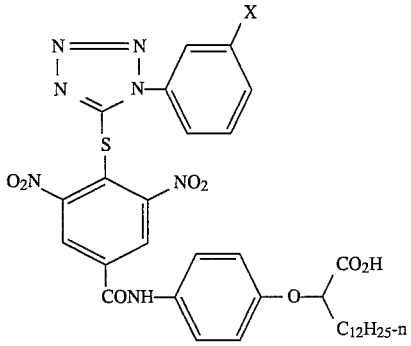
| Cmpd. # | X |
|---|---|
| 42 | $-NHCOCH_3$ |
TABLE I-A-5
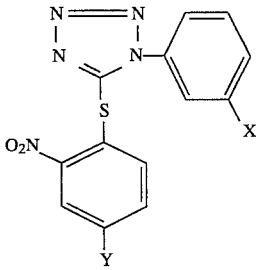
| Cmpd # | X | Y |
|---|---|---|
| 43 | H | 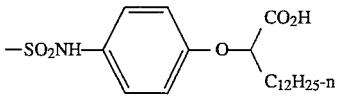 |
| 44 | $-NHCO(CH_2)_6CH_3$ | 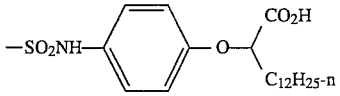 |
| 45 | H | 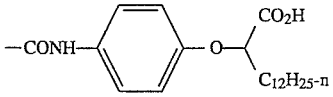 |
| 46 | $-NHCO(CH_2)_6CH_3$ | 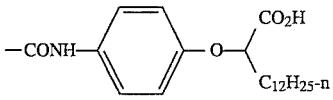 |
| 47 | H | 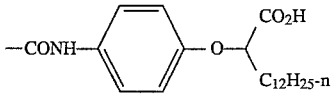 |
| 48 | $-NHCO(CH_2)_6CH_3$ | 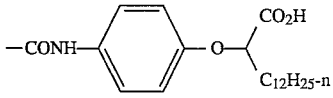 |
| 49 | $-NHCO(CH_2)_6CH_3$ | 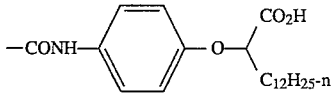 |

TABLE I-A-5-continued
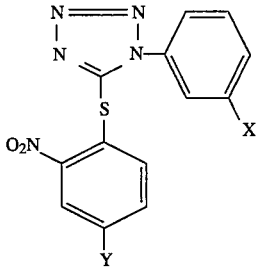
| Cmpd # | X | Y |
|---|---|---|
| 50 | H | 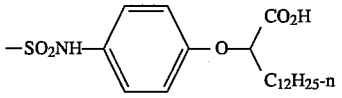 |
| 51 | H | 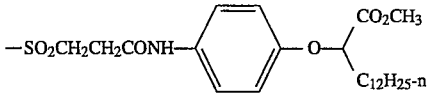 |
| 52 | $-NHCO(CH_2)_6CH_3$ | 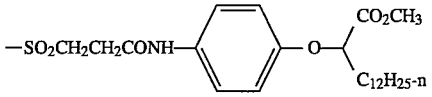 |
TABLE I-A-6
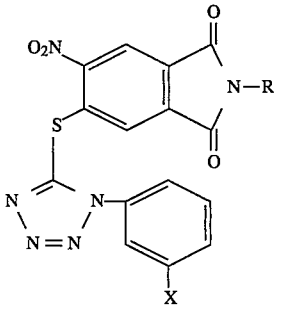
| Cmpd # | X | R |
|---|---|---|
| 53 | H | $-(CH_2)_{10}CO_2H$ |
| 54 | $-NHCO(CH_2)_6CH_3$ | $-(CH_2)_{10}CO_2H$ |
| 55 | $-NHCO(CH_2)_6CH_3$ | $-CH(CO_2H)C_{12}H_{25}$-n |
56
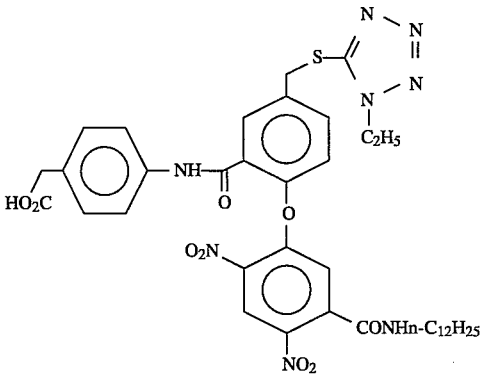
57
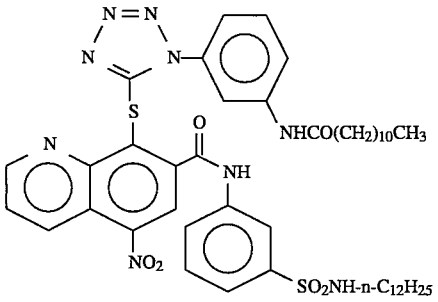

-continued

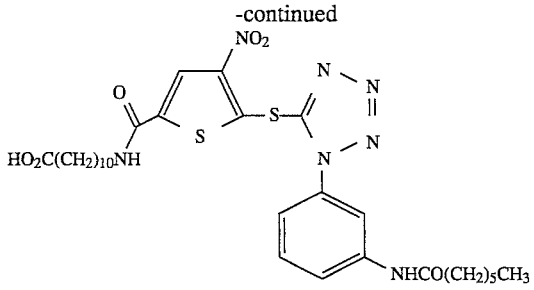

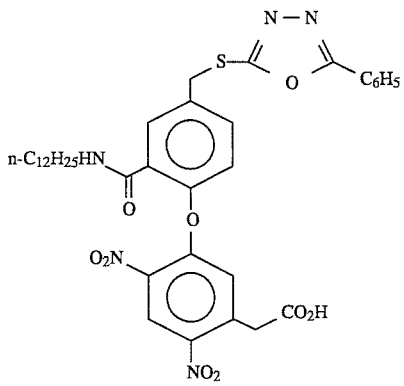

Suitable levels of release compounds utilized in the present invention are about 0.02 to about 25 millimoles/mole silver. Preferred levels are about 0.05 to about 15 millimoles/mole silver.

In addition to comprising a release compound as described above, the photographic elements of the present invention also comprise a development accelerator. By development accelerator, it is meant something somewhat broader than what is normally considered to be a development accelerator. In the present invention, the development accelerators are those technologies that impart to photographic elements the effects that classic development accelerators impart to photographic elements. That is, the development accelerators of the present invention are those means which act to shift an emulsion's characteristic curve towards lower exposure (faster speed) for each density level, often with greater effect in the lower scale than in the upper scale. Typically, the development accelerators achieve their effects by affecting silver development or dye formation. They can include any of the conventional accelerators described in U.S. Pat. No. 5,041,367, and *Research Disclosure* December 1989, Item 308119, Sections XXI B-D, published by Kenneth Mason Publications, Ltd., Dudley Annex, 12a Northe Street, Emsworth Hampshire PO10 7DQ, England, the disclosures of which are incorporated herein by reference.

Development accelerators can also include such things as competitors for oxidized developer, as described in, for example U.S. Pat. No. 4,923,787, which is incorporated herein by reference; and the incorporation of fine grain silver halide crystals (e.g., Lippmann), or fine grain silver (e.g., Carey Lea Silver), or surface or internally fogged silver halide grains, into an emulsion layer, as exemplified in U.S. Pat. Nos. 4,656,122, 4,082,553, 2,996,382, 3,178,282, 3,397,987, and 4,626,498, all of which are incorporated herein by reference.

Preferably, the development accelerators include polymeric compounds having the structure

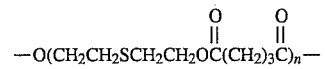

wherein n is 4 to 40 (for example, lanothane); or polyethylene glycols; quaternary salts; thioureas; silver solvents; thioethers; competitors for oxidized developer; internally sensitized silver halide grains; internally fogged silver halide grains; surface fogged silver halide grains; and Carey Lea Silver.

Suitable levels of development accelerators are dependent on the specific development accelerators utilized. For lanothane, preferred levels are from about 15 to about 2000 milligrams per mole silver, with the most preferred being from about 100 to about 1000 milligrams per mole silver. For Carey Lea Silver, the preferred levels are from about 0.0001 to about 0.1 grams per square meter, with the most preferred being from about 0.002 to about 0.02 grams per square meter. For competitors for oxidized developer, preferred levels are from about 0.001 to about 0.5 grams per square meter, with the most preferred being from about 0.005 to about 0.2 grams per square meter.

The release compounds and development accelerators employed in the present invention may be incorporated into a silver halide emulsion comprising any form (i.e. cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at Least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The release compounds and the development accelerators employed in the invention can be incorporated into any of the above layers as long as they are both incorporated into the same layer. Preferably the layer of incorporation is one of the color forming emulsion layers.

The photographic elements may also contain a transparent magnetic recording layer such as a layer containing magnetic particles on the underside of a transparent support. Magnetic layers have been described in U.S. Pat. Nos. 4,279,945 and 4,302,523, and *Research Disclosure,* November 1992, Item No. 34390, which are incorporated herein by reference. Typically, the element will have a total thickness (excluding the support) of from about 5 to about 30 microns.

In the following discussion of suitable materials for use in the elements of this invention, reference will be made to *Research Disclosure,* December 1978, Item 17643, and *Research Disclosure,* December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

The silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, iridium, thallium, lead, bismuth, cadmium and Group VIII noble metals, can be present alone, or in combination during precipitation of the silver halide emulsion. Other dopants include transition metal complexes as described in U.S. Pat. Nos. 4,981,781, 4,937,180, 4,933,272, 5,252,451 and *Research Disclosure,* Item No. 308119, Section I-D.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent. Preferably, the elements are reversal-working elements.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of elements of this invention are described in *Research Disclosure*, Item 308119, Section IX and the publications cited therein.

The elements of this invention can include couplers as described in *Research Disclosure*, Section VII, paragraphs D, E, F, and G and the publications cited therein. The couplers can be incorporated as described in *Research Disclosure*, Section VII, paragraph C, and the publications cited therein. Also contemplated are elements which further include image modifying couplers as described in *Research Disclosure*, Item 308119, Section VII, paragraph F.

The photographic elements of this invention can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known K-14 process, or the known E-6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

EXAMPLES

The following examples illustrate the syntheses of release compounds useful in the present invention. The synthesis scheme described is representative and can be varied by those skilled in the art to obtain other useful release compounds.

Preparation of Compound 1

Preparation of Intermediate-3 (I-3): 5-chloro-2,4-dinitrobenzoyl chloride (I-1, 24.6 g,) in 250 mL methylene chloride was treated with a solution of N,N-dimethylaniline (35 mL) and I-2 (37.9 g) in 100 mL methylene chloride over 20 min. After the addition, the mixture was stirred at ambient temperature for 90 min. The mixture was washed with dilute hydrochloric acid, filtered through diatomaceous earth, dried, and concentrated in vacuo. The resulting oil was triturated with acetonitrile, chilled, and filtered to afford I-3 as a yellow solid (37.5 g, 65%). I-3 proved to be chromatographically homogeneous and displayed spectroscopic characteristics consistent with the assigned structure.

Preparation of compound 1: A mixture of I-3 (10.1 g) and sodium 1-phenyl-1H-tetrazole-5-thiolate I-4, 5.2 g) was stirred in 100 mL of tetrahydrofuran at ambient temperature for 20 min. An ethyl acetate based extractive work-up afforded an oil. Silica gel chromatography eluting with mixtures of ethyl acetate in methylene chloride gave the ester as a crude oil. This oil was warmed at 85°–90° C. in a mixture of 90 mL acetic acid with 10 mL concentrated hydrochloric acid for 90 min. The mixture was diluted with water, cooled, and the solid collected by filtration. Silica gel chromatography, eluting with mixtures of ethyl acetate in methylene chloride, afforded an oil. Trituration with methanol provided compound 1 as a bright yellow solid (4.23 g, 34%). This compound proved to be chromatographically homogeneous and displayed spectroscopic characteristics consistent with its assigned structure. Combustion analysis Scheme 1

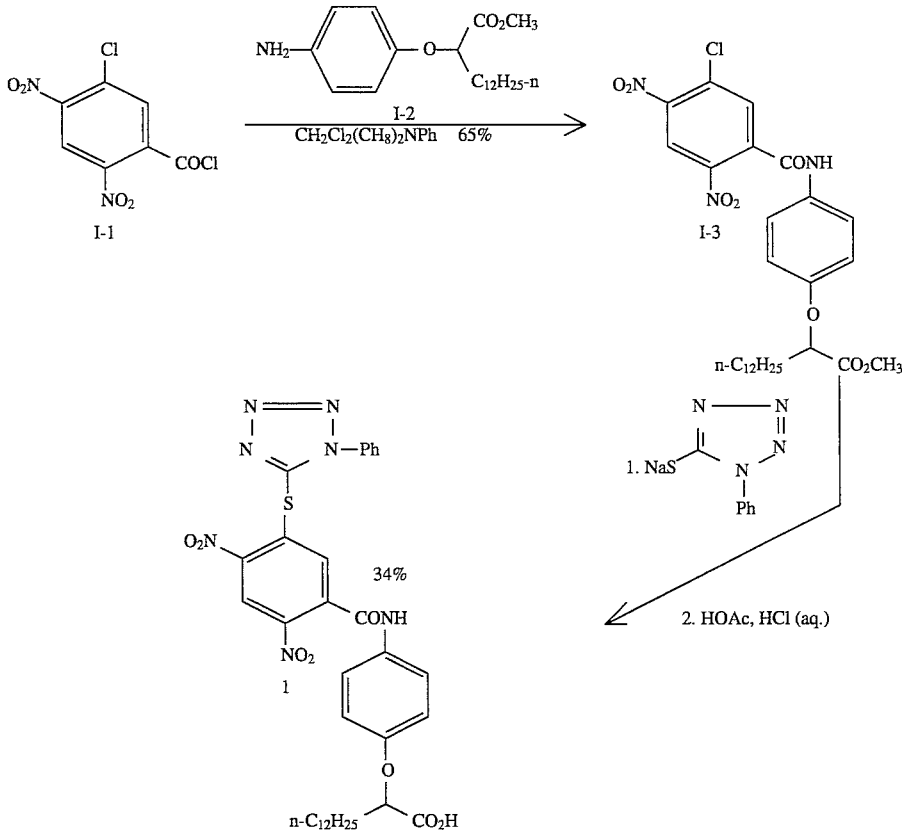

found (calculated for $C_{34}H_{39}N_7O_8S$): N 13.8 (13.9), C 57.9 (57.9), H 5.6 (5.6).

Preparation of Compound 14

Compound I-3 was prepared as described in the preparation of Compound 1. A mixture of I-3 (4.33 g), 4,5-dichlorobenzotriazole (1.41 g) and triethylamine (1.2 ml) in 50 ml tetrahydrofuran was stirred at ambient temperature for 30 minutes, after which 1,1,3,3-tetramethylguanidine (1.0 ml) was added. The mixture was allowed to stand at ambient temperature for 15 hours after which it was poured into water. Ethyl acetate extraction work-up gave an oil which was heated in a mixture of 80 ml acetic acid and 20 ml concentrated hydrochloric acid at 100° C. for 90 minutes. The mixture was poured into water. Ethyl acetate work-up afforded an oil. Xylenes were flashed off (50 ml, 3×) to afford a dry oil. Silica gel chromotography, eluting with ethyl acetate, afforded, upon ether/ligroin trituration, a yellow solid. Recrystallization from 1,2-dichloroethane gave a yellow solid (3.15 g, 58.8%, m.p. 157°–158° C.). This material proved to be chromatographically homogenous and displayed spectral characteristics consistent with its assigned structure. Combustion analysis found (calculated for $C_{33}H_{36}Cl_2N_6O_8$ 4:1 with $C_2H_4Cl_2$): N 11.3 (11.4), C 54.3 (54.3), H 5.0 (5.0).

Preparation of Compound 54

Preparation of Intermediate-5 (I-5): A mixture of 4-chloro-5-nitrophthalamide (4.53 g), N,N-dimethylacetamide (80 ml), methyl 1,1-iodoundecanoate (6.52 g) and 1,1,3,3-tetramethylguanidine were stirred at ambient temperature for fifteen minutes, then at 40° C. for one hour. The mixture was cooled to ambient temperature, then treated with 1,1,3,3-tetramethylguanidine (2.5 ml) and I-4 (N-[3-(2,5-dihydro-5-thioxo-1H-tetrazole-1-yl)phenyl] octanamide) and stirred for 30 minutes. An additional portion of 1,1,3,3-tetramethylguanidine was added and the mixture stirred a final five minutes. The mixture was poured into cold, dilute hydrochloric acid and ethyl acetate, and worked-up. Trituration with methanol (200 ml) followed to yield I-5 methyl 11-(N-4-chloro-5-nitrophthalamido undecanoate as a solid: (11.9 g. 84.2%, mp 126°–127° C.). The material proved to be chromatographically homogenous and displayed spectral characteristics consistent with its assigned structure.

Preparation of compound 54: Compound I-5 was heated in a mixture of 80 ml acetic acid and 20 ml concentrated hydrochloric acid at 40° C. for four hours. The mixture was diluted with 80 ml water and chilled. The solid was filtered, air dried, and recrystallized from acetonitrile to afford compound 54 as a yellow solid (3.9 g, 66.0%, m.p. 132°–133° C.). This material proved to be chromatographically homogenous and displayed spectral characteristics consistent with its assigned structure. Combustion analysis found (calculated for $C_{34}H_{43}N_7O_7S$ N 14.2 (14.1): C 59.0 (58.9), H 6.2 (6.2)

The practice of the invention is described in detail below with reference to specific illustrative examples, but the invention is not to be construed as being limited thereto.

EXAMPLE 1

The following layers were coated on a cellulose triacetate film support provided with a subbing layer to form a photographic element, which was designated Sample 001.

In the composition of the layers, the coating amounts are shown in grams per meter squared, except for sensitizing dyes, which are shown in millimolar amount per mole of silver halide present in the same layer. Specific compounds utilized are described following the coating description.

| | |
|---|---|
| First layer: Antihalation Layer | |
| Antihalation Colloidal Silver | 0.43 (as silver) |
| Gelatin | 2.45 |
| Second layer: Intermediate Layer | |
| Gelatin | 1.22 |
| Third layer: Slow Red Sensitive Layer | |
| Silver Iodobromide Emulsion (tabular; aspect ratio approx. 6) | 0.59 (as silver) |
| Red Sensitizing Dye-1 | 0.9 |
| Red Sensitizing Dye-2 | 0.09 |
| Coupler C-1 | 0.19 |
| Solvent-1 | 0.10 |
| Competitor | 0.03 |
| Solvent-2 | 0.03 |
| Gelatin | 0.86 |
| Fourth Layer: Fast Red Sensitive Layer | |
| Silver Iodobromide Emulsion (tabular; aspect ratio approx 4.5) | 0.70 (as silver) |
| Red Sensitizing Dye-1 | 0.7 |
| Red Sensitizing Dye-2 | 0.06 |
| Coupler C-1 | 1.10 |
| Solvent-1 | 0.55 |
| Gelatin | 1.83 |
| Fifth layer: Intermediate Layer | |
| Interlayer scavenger | 0.16 |
| Inhibitor (free) | 0.001 |
| Gelatin | 0.61 |
| Sixth Layer: Magenta Filter Layer | |
| Magenta Filter Dye | 0.06 |
| Gelatin | 0.61 |
| Seventh Layer: Slow Green Sensitive Layer | |
| Silver Iodobromide Emulsion (tabular; aspect ratio approx 6.6) | 0.59 (as silver) |
| Green Sensitizing Dye-1 | 0.75 |
| Green Sensitizing Dye-2 | 0.25 |
| Coupler M-1 | 0.15 |
| Coupler M-2 | 0.06 |
| Solvent-2 | 0.11 |
| Gelatin | 0.86 |
| Eighth Layer: Fast Green Sensitive Layer | |
| Silver Iodobromide Emulsion (tabular; aspect ratio approx 7.1) | 0.48 (as silver) |
| Green Sensitizing Dye-1 | 0.75 |
| Green Sensitizing Dye-2 | 0.25 |
| Coupler M-1 | 0.68 |
| Coupler M-2 | 0.29 |
| Solvent-2 | 0.48 |
| Gelatin | 1.67 |
| Ninth Layer: Intermediate Layer | |
| Gelatin | 2.15 |
| Tenth Layer: Yellow Filter Layer | |
| Interlayer scavenger | 0.11 |
| Yellow Filter Dye | 0.20 |
| Gelatin | 0.61 |
| Eleventh Layer: Slow Blue Sensitive Layer | |
| Silver Iodobromide Emulsion | 0.25 (as silver) |
| Fine Grain Silver Bromide | 0.02 (as silver) |
| Blue Sensitizing Dye-1 | 1.08 |
| Coupler Y-1 | 0.59 |

-continued

| | |
|---|---|
| Solvent-1 | 0.20 |
| Gelatin | 0.86 |
| Twelfth Layer: Fast Blue Sensitive Layer | |
| Silver Iodobromide Emulsion (tabular; aspect ratio approx. 22) | 0.70 (as silver) |
| Blue Sensitizing Dye-1 | 1.6 |
| Coupler Y-1 | 1.59 |
| Solvent-1 | 0.53 |
| Gelatin | 2.37 |
| Thirteenth Layer: First Protective Layer | |
| UV Protection Dye-1 | 0.38 |
| UV Protection Dye-2 | 0.07 |
| UV Protection Dye-3 | 0.09 |
| Interlayer scavenger | 0.06 |
| Gelatin | 1.40 |
| Fourteenth Layer: Second Protective Layer | |
| Bisvinylsulfonymethane | 0.29 |
| Fine Grain Silver Bromide (0.07 μm equivalent spherical diameter) | 0.12 (as silver) |
| Fine Silver Particle (Carey Lea Silver (CLS)) | 0.003 (as silver) |
| Matte (3.3 μm spherical diameter) | 0.02 |
| Gelatin | 0.98 |

The components employed for the preparation of the light-sensitive materials not already identified above are as follows:

Red Sensitizing Dye-1

Benzothiazolium, 5-chloro-2-(2-((5-chloro-3-(2-hydroxy-3-sulfopropyl)-2( 3H)-benzothiazolylidene)methyl)-1-butenyl)-3-(2-hydroxy-3-sulfopropyl)-, compound with N,N-diethylethanamine.

Red Sensitizing Dye-2

Benzothiazolium, 5-methyl-2-(2-((5-methyl-3-(3-sulfopropyl)-2 (3H)-benzothiazolylidene)methyl)-1-butenyl)-3-(3-sulfopropyl)-, compound with N,N-diethylethanamine.

Green Sensitizing Dye-1

Benzothiazolium, 5-chloro-2-(2-((5-chloro-3-(3-sulfopropyl)-2 (3H)-benzothiazolylidene)methyl)- 1-butenyl)-3-(3-sulfopropyl)-, compound with N,N-diethylethanamine.

Green Sensitizing Dye-2

Anhydro-5-chloro-9-ethyl-3'-(2-carboxyethyl)-3-(3-sulfopropyl) oxathiacarbocyanine hydroxide, diisopropylamine salt.

Blue Sensitizing Dye

Anhydro-5'-chloro-3,3'-bis-(3-sulfopropyl)naphth[1,2-d] exazolsthiacyanine hydroxide, triethylammonium salt.

Coupler C-1, (Hexanamide, 2-[2,4-bis (1,1-dimethylproply)phenoxy]-N- [4- [ 2,2,3,3,4,4,4-heptafluoro-1-oxobutyl)amino]-3-hydroxyphenyl]-)

Coupler M-1, Benzamide, 3- ((2- (2,4-bis (1,1-dimethylpropyl)phenoxy)-1-oxobutyl)amino)-N-( 4,5-dihydro-5-oxo-1-(2,4,6-trichlorophenyl)-1H-pyrazol-3-yl)

Coupler M-2, (Benzamide, 3-[[[2,4-bis(1,1-dimethylpropyl)phenoxy]acetyl]amino]-N-[4,5-dihydro-5-oxo-1-(2,4,6-trichlorophenyl)-1H-pyrazol-3-yl]-)

Coupler Y-1, (Benzoic acid, 4-chloro-3-[[2-[4-ethoxy-2,5-dioxo-3-(phenylmethyl)- 1-imazolidinyl]-4,4-dimethyl-1,3 -dioxopentyl]amino]-, dodecyl)

Solvent 1—tritolyl phosphate

Solvent 2—dibutyl phthalate

Interlayer scavenger (competitor)—Dodecanoic acid, 2-(4-((4-hydroxyphenyl)sulfonyl)phenoxy)-, 2-(4-( 1-methylbutoxy)phenyl)hydrazide Magenta Filter Dye—Benzoic acid, 4-(4-(3-(1-(4-carboxyphenyl)-1,5-dihydro-3-methyl- 5-oxo-4H-pyrazol-4-ylidene)-1-propenyl)-5-hydroxy-3-methyl-1H-pyrazol-1-yl)

Yellow Filter Dye—1-Butanesulfonamide, N-(4-(4-cyano-2-(2-furanylmethylene)-2,5-dihydro- 5-oxo-3-furanyl)phenyl) Inhibitor—4-carboxymethyl-4-thiazolinethione (CMTT)

UV Protection Dye-1, (Phenol, 2-(2H-benzotriazol-2-yl-)4, 6-bis (1,1-dimethylpropyl)-)

UV Protection Dye-2, (2-[(2-Hydroxy-3-3-(1,1-dimethylethyl)5-methyl)phenyl]-5-chloro Benzotriazole)

UV Protection Dye-3, Propanedinitrile, (3-(dihexylamino)-2-propenylidene)

Samples 002–004 were prepared in the same manner as Sample 001, except for the addition of a blocked or unblocked inhibitor to the seventh layer. Sample 002 incorporated unblocked inhibitor and Samples 003 and 004 incorporated blocked inhibitor. Samples 002 and 003 had the same molar level of inhibitor.

Each of the samples thus prepared was cut into a 35 mm width strip and exposed through a wedge for sensitometry using white light emitted from a 5,500° K. light source. The samples were processed utilizing standard E-6 processing solutions and methods; allowance was made for both normal and extended, i.e. push, processing in the first developer. Normal processing time in the first developer was six minutes. Push processing time in the first developer was selected to be eleven minutes.

The Status A density was measured and transformed into equivalent neutral density according to methods well-known in the art. Photographic sensitivity (speed) of the magenta record was determined at D=1.6 at both normal and push processing times, and was calculated in terms of 0.01 LogH units where H is the exposure. The difference between these two sensitivities is indicated below in Table 1 as Δ Speed, which is a measure of the impact the blocked or unblocked inhibitor has on the sensitivity of the emulsion during extended first development.

In Table 1, Speed represents sensitivity during normal processing. The values listed have been standardized relative to Sample 001 so that one may readily determine the impact the blocked or unblocked inhibitor has on the sensitivity of a photographic element during normal and extended processing times.

TABLE 1

| Sample | Compound | Level g/m$^2$ | SPEED | ΔSPEED |
|---|---|---|---|---|
| 001 | none | — | 0 | 46 |
| 002 | I-1 | 0.0004 | −33 | 43 |
| 003 | 4 | 0.0011 | 0 | 42 |
| 004 | 4 | 0.0030 | −4 | 45 |

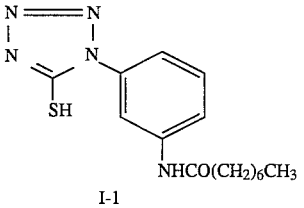

I-1

As can be seen from Table 1, unblocked inhibitors such as I-1 cause substantial sensitivity losses at normal processing times. By contrast, blocked inhibitors such as Compound 4, which release primarily during push processing, cause minimal sensitivity losses during normal processing times. When their levels are increased, however, sensitivity losses during normal processing may begin to appear.

In Table 2, shown below, the sensitivity impact of blocked inhibitors during normal (six minutes) and extended (11 minutes) processing times was further examined. In Table 2, blocked inhibitor Compound 32 was incorporated into the slow cyan layer of a photographic element similar to the photographic element described previously. The speed of the cyan record at a density of 1.0 was determined at both normal and extended processing times. SPEED and ΔSPEED, for the cyan record, are shown in Table 2.

TABLE 2

| Sample | Compound | Level g/m$^2$ | SPEED | ΔSPEED |
|---|---|---|---|---|
| 005 | none | — | 0 | 0 |
| 006 | 32 | 0.0014 | −1 | −4 |
| 007 | 32 | 0.0037 | −4 | −4 |

As with Table 1, Table 2 demonstrates that blocked inhibitors, although primarily impacting only push sensitivity, also slightly impact sensitivity during normal processing times. This impact can be negated by incorporation of a development accelerator into the same layer as the blocked inhibitor, as described in subsequent examples.

EXAMPLE 2

Photographic elements were prepared as in Example 1 except the below-described variations were made in the third layer. Sample 101 was prepared in the same manner as Sample 001. Samples 102–104 were prepared in the same manner as Sample 101 except that fine grain silver halides (Lippmann bromide) and blocked inhibitor Compound 32 were added to the third layer in the levels described in Table 3. The fine grain silver halides were added as the development accelerator employed in the present invention.

In Table 3, Speed and ΔSpeed are as defined previously, and were measured relative to the cyan record at density equal to 0.5. Sample 102 was standardized to Sample 101. Sample 104 was standardized to Sample 103. The levels of the accelerator and Compound 32 are indicated in terms of g/m$^2$.

TABLE 3

| Sample | Description | Accelerator Level | Cmpd-32 Level | Speed | Δ Speed |
|---|---|---|---|---|---|
| 101 | Comparison | 0 | 0 | 0 | 0 |
| 102 | Comparison | 0 | 0.0023 | −9 | −4 |
| 103 | Comparison | 0.1 | 0 | 0 | 0 |
| 104 | Invention | 0.1 | 0.0023 | −4 | −5 |

As can be seen from the data, incorporation of a development accelerator into the same layer as a blocked inhibitor allows one to achieve a significant reduction in the impact of blocked inhibitors during normal processing times. This is accomplished without deleteriously affecting the inhibitor's ability to impact sensitivity during push processing.

EXAMPLE 3

Samples 401–404 were prepared similarly to the elements of Example 1. Sample 401 was analogous to Sample 001, and had incorporated into its emulsions neither a blocked inhibitor nor a development accelerator. In Samples 402–403, either the blocked inhibitor Compound 4 or a competitor for oxidized developer, Dodecanoic acid, 2-(4-((4-hydroxyphenyl)sulfonyl)phenoxy)-, 2-(4-(1-methylbutoxy)phenyl)hydrazide, was incorporated into the third layer. In Sample 404, both a blocked inhibitor and a competitor for oxidized were incorporated into the third layer. The competitor for oxidized developer was utilized for its development accelerating properties.

In Table 4, Speed and ΔSpeed are as defined previously, and were measured relative to the cyan color record at density equal to 0.5. Sample 402 was standardized to Sample 401. Sample 404 was standardized to Sample 403. The levels of the accelerator and Compound 4 are indicated in terms of g/m$^2$.

TABLE 4

| Sample | Description | Accelerator Level | Cmpd 4 Level | Speed | Δ Speed |
|---|---|---|---|---|---|
| 401 | Comparison | 0 | 0 | 0 | 0 |
| 402 | Comparison | 0 | 0.0037 | −2 | −9 |
| 403 | Comparison | 0.05 | 0 | 0 | −6 |
| 404 | Invention | 0.05 | 0.0037 | +1 | −9 |

Again, the data demonstrates that incorporation of a development accelerator into the same layer as a blocked inhibitor allows one to achieve a significant reduction in the impact of blocked inhibitors during normal processing times. This is accomplished without deleteriously affecting the inhibitor's ability to impact sensitivity during push processing.

EXAMPLE 4

Samples 501–509 were prepared similarly to the elements of Example 3. Sample 501 was analogous to Sample 001 and was free of blocked inhibitors and development accelerators. In Samples 502–504, the blocked inhibitor Compound 4 was incorporated into the third layer. In Samples 505–509, both Compound 4 and Lanothane, a conventional development accelerator, were incorporated into the third layer.

In Table 5, Speed and ΔSpeed are as defined previously, and were measured relative to the cyan color record at density equal to 0.5. Speed and ΔSpeed were measured relative to Sample 501. $D_{max}$ represents the maximum density of the cyan record during normal processing times (six minutes), and $\Delta D_{max}$ represents the maximum densities of the cyan record during extended processing times (eleven minutes). Each is measured relative to Sample 501. The levels of the accelerator and Compound 4 are indicated in terms of g/m$^2$.

TABLE 5

| Sample | Description | Accelerator Level | Compound 4 Level | Dmax | SPEED | ΔDmax | ΔSPEED |
|---|---|---|---|---|---|---|---|
| 501 | Check | — | | 0 | 0 | 0 | 0 |
| 502 | Comparison | — | 0.0037 | 0.101 | −6 | 0.04 | −6 |
| 503 | Comparison | — | 0.0074 | 0.110 | −11 | 0.03 | −6 |
| 504 | Comparison | — | 0.0148 | 0.176 | −20 | 0.05 | −8 |

TABLE 5-continued

| Sample | Description | Accelerator Level | Compound 4 Level | Dmax | SPEED | ΔDmax | ΔSPEED |
|---|---|---|---|---|---|---|---|
| 505 | Invention | 0.0012 | 0.0037 | 0.087 | −1 | 0.00 | −3 |
| 506 | Invention | 0.0012 | 0.0074 | 0.052 | −4 | 0.02 | −7 |
| 507 | Invention | 0.0024 | 0.0074 | 0.113 | 1 | 0.02 | −11 |
| 508 | Invention | 0.0048 | 0.0148 | 0.126 | −8 | 0.05 | −12 |
| 509 | Invention | 0.0096 | 0.0148 | 0.137 | 7 | 0.01 | −11 |

Incorporation of a development accelerator into the same layer as a blocked inhibitor allows one to achieve a significant reduction in the impact of blocked inhibitors during normal processing times. This is accomplished without deleteriously affecting the inhibitor's ability to impact sensitivity during push processing.

The invention has been described in detail with particular reference to preferred embodiments thereof, but it will be understood that variations and modifications can be effected within the spirit and scope of the invention.

What is claimed:

1. A silver halide color reversal, black and white, or color negative photographic element comprising a support having located thereon at least one silver halide emulsion layer, the emulsion layer containing a development accelerator and release compound that provides a non-imagewise distribution of a development inhibitor moiety, the release compound comprising a blocking group from which the development inhibitor moiety is released, a ballasting group other than a coupler moiety, and an aqueous solubilizing group, both the ballasting group and the aqueous solubilizing group being attached to the blocking group, and not directly to the development inhibitor moiety, wherein:

(a) the blocking group comprises an aromatic ring system which is unsubstituted or substituted with one or more electron withdrawing groups and, optionally, a timing group or series of timing groups from which the development inhibitor moiety is released;

(b) the aqueous solubilizing group is attached, either directly or indirectly, to a timing group, or is attached indirectly through at least one carbon atom to the aromatic ring system; and (c) the active functionality of the development inhibitor moiety is a heteroatom which is blocked by direct attachment to a timing group or aromatic ring of the aromatic ring system.

2. A photographic element according to claim 1 wherein the photographic element is a color reversal or black and white photographic element.

3. A photographic element according to claim 1 wherein the aromatic ring system is capable of being removed from the blocking group to release the timed or untimed development inhibitor moiety during processing as a result of reaction with a nucleophile contained in a processing bath.

4. A photographic element according to claim 3 wherein the release compound has the structure

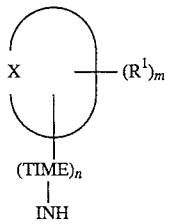

wherein

X represents the atoms to complete an aromatic ring system;

$R^1$ is an electron withdrawing moiety;

m is 0, 1, 2 or 3;

TIME is a timing group;

n is 0, 1, 2 or 3;

INH is a development inhibitor moiety; and wherein the release compound further comprises a ballasting group other than a coupler moiety, and an aqueous solubilizing group, the ballasting group attached either directly or indirectly to TIME or X, and the aqueous solubilizing group attached either directly or indirectly to TIME, or attached indirectly to X through at least one carbon atom.

5. A photographic element according to claim 4 wherein X represents a five or six membered aromatic ring comprised of substituted or unsubstituted carbon atoms, or nitrogen atoms wherein no more than three nitrogen atoms are present in the ring.

6. A photographic element according to claim 5 wherein the ballasting group is attached either directly or indirectly to X, and the aqueous solubilizing group is attached indirectly to X through at least one carbon atom.

7. A photographic element according to claim 6 wherein the release compound is selected from

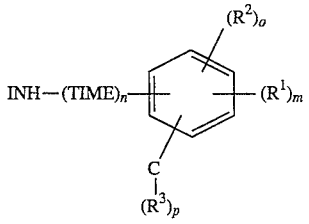

and

-continued

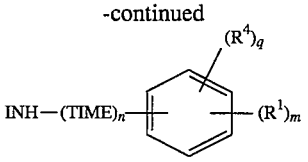

wherein $R^1$, m, n, TIME and INH are as defined in claim 8;

$R^2$ is a group containing a ballasting group;

o is 1 or 2;

$R^3$ is a group containing an aqueous solubilizing group;

p is 1 or 2;

$R^4$ is a group containing both a ballasting group and an aqueous solubilizing group, wherein the aqueous solubilizing group is attached to the six-membered carbocyclic ring through at least one carbon atom; and q is 1 or 2.

8. A photographic element according to claim 7 wherein $R^4$ comprises a substituted or unsubstituted aromatic group having attached thereto

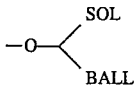

wherein

SOL is an aqueous solubilizing group; and

BALL is a ballasting group.

9. A photographic element according to claim 8 wherein the release compound has the structure

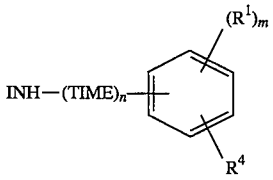

wherein $R^1$, m, n, TIME and INH are as defined in claim 8, and $R^4$ is represented by the structure

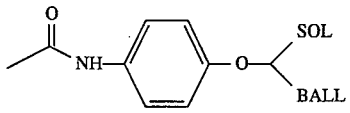

wherein BALL is a ballasting group and SOL is a solubilizing group.

10. A photographic element according to claim 8 wherein INH is selected from substituted or unsubstituted mercaptotetrazoles, mercaptotriazoles, mercaptoimidazoles, mercaptopyrimidines, mercaptobenzimidazoles, mercaptooxadiazoles, mercaptothiadiazoles, mercaptobenzothiazoles, mercaptobenzoxazoles, benzimidazoles indazoles, and substituted or unsubstituted symmetric or unsymmetric benzotriazoles.

11. A photographic element according to claim 10 wherein the release compound is

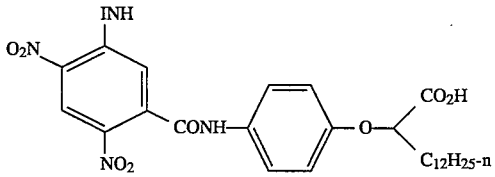

wherein INH is as described in claim 13.

12. A photographic element according to claim 1 wherein the development accelerator is selected from the group consisting of polyethylene glycols, quaternary salts, thioureas, silver solvents, thioethers, Carey Lea Silver and lanothane.

13. A photographic element according to claim 12 wherein the development accelerator is lanothane.

14. A photographic element according to claim 1 wherein the aromatic ring system is substituted with one or more electron withdrawing groups.

15. A silver halide color reversal, black and white, or color negative photographic element comprising a support having located thereon at least one silver halide emulsion layer, the emulsion layer containing a development accelerator and release compound that provides a non-imagewise distribution of a development inhibitor moiety, the release compound comprising a blocking group comprising a carbocyclic ring and, optionally, a timing group or series of timing groups from which the development inhibitor moiety is released, and the development inhibitor moiety comprising as its active functionality a heteroatom which is blocked by direct attachment to a timing group or the carbocyclic ring.

* * * * *